US006602152B2

(12) United States Patent
Yamagishi et al.

(10) Patent No.: US 6,602,152 B2
(45) Date of Patent: Aug. 5, 2003

(54) GOLF BALL

(75) Inventors: Hisashi Yamagishi, Chichibu (JP); Junji Hayashi, Chichibu (JP); Yasumasa Shimizu, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/998,658

(22) Filed: Dec. 3, 2001

(65) Prior Publication Data

US 2003/0083157 A1 May 1, 2003

(30) Foreign Application Priority Data

Oct. 23, 2001 (JP) ..... 2001-324334

(51) Int. Cl.[7] ..... A63B 37/06
(52) U.S. Cl. ..... 473/377
(58) Field of Search ..... 473/351, 377, 473/378, 368, 369

(56) References Cited

U.S. PATENT DOCUMENTS 4,570,937 A * 2/1986 Yamada ..... 473/377
5,403,010 A * 4/1995 Yabuki et al. ..... 473/372
5,516,110 A * 5/1996 Yabuki et al. ..... 473/372
5,645,496 A * 7/1997 Endo et al. ..... 473/372
5,702,312 A * 12/1997 Horiuchi et al. ..... 473/377
5,803,833 A * 9/1998 Nakamura et al. ..... 473/377
5,803,834 A * 9/1998 Yamagishi et al. ..... 473/377
5,863,264 A * 1/1999 Yamagishi et al. ..... 473/377
6,386,993 B1 * 5/2002 Yokota ..... 473/373

FOREIGN PATENT DOCUMENTS

JP 11-290479 * 10/1999 ..... A63B/37/00

* cited by examiner

*Primary Examiner*—Mark S. Graham
*Assistant Examiner*—Raeann Gorden
(74) *Attorney, Agent, or Firm*—Sughrue Mion, PLLC

(57) ABSTRACT

A golf ball including a sold core and a cover is provided. A deformed amount of the solid core, measured by applying a load of 980 N thereto, is in a range of 4.0 to 6.0 mm. A JIS-C hardness of the cover is in a range of 75 to 95. A JIS-C hardness (Sh) of a surface of the core and a JIS-hardness (Ch) of a center portion of the core satisfy a relationship of $1.55 \times Ch - 16 \leqq Sh \leqq 1.55 \times Ch - 10$. A JIS-C hardness (Vh) of the cover and a JIS-C hardness (Sh) of the surface of the core satisfy a relationship of $0.9 \times Vh - 70 \leqq Vh - Sh \leqq 0.9 \times Vh - 50$. The hardnesses of the center portion of the core, the surface of the core, and the cover become higher in this order. With this configuration, the golf ball can exhibit a high carrying performance, a good controllability, a desirable very soft feeling of hitting, and an excellent durability against continuous hitting.

7 Claims, 1 Drawing Sheet

G --- Golf Ball
1 --- Solid Core
2 --- Cover

G --- Golf Ball
1 --- Solid Core
2 --- Cover

GOLF BALL

BACKGROUND OF THE INVENTION

The present invention relates to a golf ball with improved carrying performance, controllability, feeling characteristic, and durability against hitting of the golf ball.

In recent years, soft golf balls for giving soft feeling of hitting the golf balls to golf players have been increasingly required. With respect to such soft golf balls, however, if a core deformed by 4.0 mm or more under a load of 980 N is used, there have often arisen an inconvenience that the durability against continuous hitting of the golf ball has become weak. Such golf balls have also been required to be improved in terms of carrying performance and controllability.

SUMMARY OF THE INVENTION

An object of the present invention is to provide a golf ball having a high resilience enough to enhance a carrying performance, a good controllability, a desirable soft feeling of hitting, and an excellent durability against hitting.

To achieve the above object, the present inventors have earnestly examined a golf ball having a solid core deformed by an amount of 4.0 to 6.0 mm under a load of 980 N, and found that a golf ball capable of improving a durability against continuous hitting, improving a resilience upon impact by imparting a desirable energy efficiency while preventing excessive deformation of the ball upon hitting, allowing a golf player at the level of relatively low head speed (40 m/sec or less) to ensure a sufficient carry of the ball, enhancing a controllability upon puttering or short-approach, and ensuring a very soft feeling of hitting the ball for players, can be obtained by specifying a JIS-C hardness of a cover provided to cover a solid core of the golf ball in a range of 75 to 95 and controlling a center hardness and a surface hardness of the core and a cover hardness in a specific range. On the basis of the above knowledge, the present invention has been accomplished.

According to an aspect of the present invention, there is provided a golf ball including a solid core and a cover, wherein a deformed amount of the solid core, measured by applying a load of 980 N thereto, is in a range of 4.0 to 6.0 mm; a JIS-C hardness of the cover is in a range of 75 to 95; a JIS-C hardness (Sh) of a surface of the core and a JIS-C hardness (Ch) of a center portion of the core satisfy a relationship of $1.55\times Ch-16 \leqq Sh \leqq 1.55\times Ch-10$; a JIS-C hardness (Vh) of the cover and a JIS-C hardness (Sh) of the surface of the core satisfy a relationship of $0.9\times Vh-70 \leqq Vh-Sh \leqq 0.9\times Vh-50$; and the hardnesses of the center portion of the core, the surface of the core, and the cover become higher in this order.

The JIS-C hardness of the center portion of the core is preferably in a range of 40 to 65.

The JIS-C hardness of the surface of the core is preferably in a range of 55 to 80.

The cover is preferably formed from a base resin containing an inorganic filler in an amount of 2 parts by weight on the basis of 100 parts by weight of the base resin.

A thickness of the cover is preferably in a range of 1.0 to 2.3 mm.

DETAILED DESCRIPTION OF THE INVENTION

Figure 1:
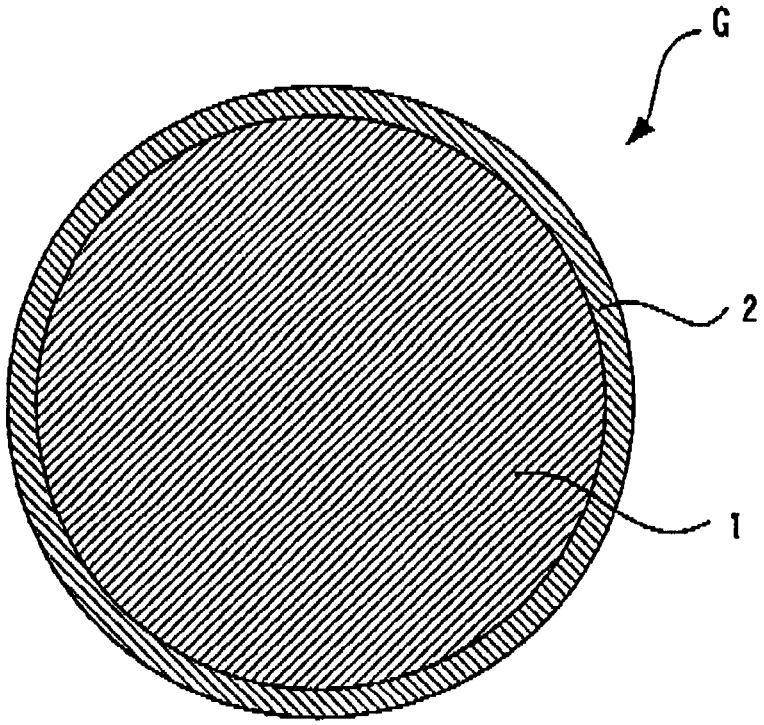
FIG. 1 illustrates a golf ball according to the present invention.

A golf ball of the present invention is a solid golf ball G including a solid core 1 and a cover 2.

The present invention will be hereinafter described in detail.

The solid core 1 can be produced by vulcanizing a rubber composition. The rubber composition may contain a main rubber component, an unsaturated carboxylic acid and/or a metal salt thereof as a crosslinking agent, and an organic peroxide.

As the above-described main rubber component, there is preferably used polybutadiene, particularly, cis-1,4 -polybutadiene. In this case, another diene based rubber, such as styrene-butadiene rubber (SBR), natural rubber, isoprene rubber, or ethylene-propylene-diene rubber (EPDM) may be suitably mixed with polybutadiene as a main component of the main rubber component, as needed.

Examples of the unsaturated carboxylic acids, each of which is usable as the crosslinking agent of the main rubber component, may include acrylic acid, metacrylic acid, maleic acid, fumaric acid. In particular, acrylic acid and metacrylic acid are preferably used.

Examples of the metal salts of unsaturated carboxylic acids may include zinc salts and magnesium salts of unsaturated aliphatic acids, for example, zinc metacrylate and zinc acrylate. In particular, zinc acrylate is preferably used.

The content of the unsaturated carboxylic acid and/or metal salt thereof may be set, on the basis of 100 parts (parts by weight, the same applying hereinafter) of the main rubber component, in a range of 10 parts or more, preferably, 15 parts or more, more preferably, 20 parts or more, with the upper limit being set in a range of 50 parts or less, preferably, 45 parts or less, more preferably, 40 parts or less, most preferably, 35 parts or less. If the content is excessively small, the resilience is reduced, while if excessively large, the solid core becomes excessively hard, thereby often causing undesirable player's feeling of hitting of the golf ball.

As the organic peroxide, there can be used a commercial product such as "Percumyl D" (sold by NOF CORPORATION), "Perhexa 3M" (sold by NOF CORPORATION), "Luperco 231XL" (sold by Elf Atochem Japan). Two kinds or more organic peroxides may be used in combination, as needed.

The content of the organic peroxide may be set, on the basis of 100 parts of the main rubber component, in a range of 0.1 part or more, preferably, 0.3 part or more, more preferably, 0.5 part or more, most preferably, 0.7 part or more, with the upper limit being set in a range of 5 parts or less, preferably, 4 parts or less, more preferably, 3 parts or less, most preferably, 2 parts or less. If the content is excessively large or small, the resilience, feeling of hitting the golf ball, and durability may not be obtained.

The rubber composition of the present invention may contain, in addition to the above-described essential components, an inorganic filler for adjusting a specific gravity of the rubber composition, as needed. Examples of the inorganic fillers may include zinc oxide, barium sulfate, and calcium carbonate. In order to obtain a suitable weight and a desirable resilience, the content of the inorganic filler may be set, on the basis of 100 parts of the main rubber component, in a range of 1 part or more, preferably, 3 parts or more, more preferably, 5 parts or more, most preferably, 7 parts or more, with the upper limit being set in a range of 60 parts or less, preferably, 50 parts or less, more preferably, 45 parts or less, most preferably, 40 parts or less.

An antioxidant may be further added to the rubber composition of the present invention, as needed. As the antioxidant, there can be used a commercial product such as "NOCRAC NS-6, NS-30" (sold by Ouchi-Sinko Chemical Industrial Co., Ltd.), or "Yoshinox 425" (Yoshitomi Pharmaceutical Co., Ltd.). In order to obtain desirable resilience and durability, the content of the antioxidant may be set, on the basis of 100 parts of the main rubber component, in a range of 0 part or more, preferably, 0.05 part or more, more preferably, 0.1 part or more, most preferably, 0.2 part or more, with the upper limit being set in a range of 3 parts or less, preferably, 2 parts or less, more preferably, 1 part or less, most preferably, 0.5 part or less.

The rubber composition of the present invention may contain an organic sulfur compound, as needed. Examples of the organic sulfur compounds may include thiophenol, thionaphthol, halogenated thiophenol, or metal salts thereof, more concretely, zinc salts of pentachlorothiophenol, pentafluorothiophenol, pentabromothiophenol, and parachlorothiophenol; and diphenyl polysulfide, dibenzil polysulfide, dibenzoil polysulfide, dibenzothiazoil polysulfide, and dithiobenzoil polysulfide, each of which has the sulfur number of 2 to 4. In particular, a zinc salt of pentachlorothiophenol or diphenyl disulfide is preferably used. The content of the organic sulfur compound may be set, on the basis of 100 parts of the main rubber component, in a range of 0.05 part or more, preferably, 0.1 part or more, more preferably, 0.2 part or more, with the upper limit being set in a range of 5 parts or less, preferably, 4 parts or less, more preferably, 3 parts or less, most preferably, 2.5 parts or less.

The solid core of the present invention can be formed by vulcanizing and hardening the above-described rubber composition by a known process. For example, a vulcanizing temperature may be set in a range of 100 to 200° C., and a vulcanizing time be set in a range of 10 to 40 min.

According to the present invention, the hardness of the solid core, which is expressed in a deformed amount of the solid core measured by applying a load of 980 N (100 kg) thereto, may be set in a range of 4.0 mm or more, preferably, 4.2 mm or more, more preferably, 4.3 mm or more, with the upper limit being set in a range of 6.0 mm or less, preferably, 5.9 mm or less, more preferably, 5.2 mm or less. If the flexural amount (deformed amount) is excessively small, the feeling of hitting the golf ball becomes harder, and particularly, the spin of the ball becomes excessively high at the time of long-shot with a driver when the ball is liable to be largely deformed, to reduce the carry of the ball, while if excessively large, the feeling of hitting the ball becomes dull, the carry of the ball is reduced because of the insufficient resilience of the ball, and the durability against cracking due to repeated hitting is degraded.

According to the present invention, a surface hardness (Sh) and a center hardness (Ch) of the solid core, each of which is expressed in JIS-C hardness measured by using a C-type hardness meter specified under JIS K6301, are required to satisfy the following relationship:

$$1.55\times Ch-16 \leqq Sh < 1.55\times Ch-10 \quad (1)$$

In this case, the JIS-C hardness (Sh) of the surface of the core may be set in a range of 55 or more, preferably, 58 or more, more preferably, 60 or more, with the upper limit being set in a range of 80 or less, preferably, 78 or less, more preferably, less than 77. The JIS-C hardness (Ch) of the center portion of the core may be set in a range of 40 or more, preferably, 45 or more, more preferably, 46 or more, with the upper limit being set in a range of 65 or less, preferably, 63 or less, more preferably, 60 or less, most preferably, less than 58. If the surface hardness (Sh) of the core is lower than the value of (1.55×Ch−16), the durability and the feeling of hitting may be degraded. Meanwhile, if higher than (1.55×Ch−10), the feeling of hitting may be degraded. If the center hardness (Ch) of the core is excessively lower, the resilience may be insufficient and the feeling of hitting be degraded. If the center hardness (Ch) of the core is excessively high, the feeling of hitting may be degraded.

In addition, the deformed amount and the hardness distribution of the core can be determined by suitably selecting the kinds and amounts of components of the rubber composition and the vulcanizing condition.

The diameter of the solid core of the present invention may be set in a range of 38.0 mm or more, preferably, 38.5 mm or more, more preferably, 38.7 mm or more, most preferably, 38.9 mm or more, with the upper limit being set in a range of 41.0 mm or less, preferably, 40.7 mm or less, more preferably, 40.3 mm or less, most preferably, 40.1 mm or less.

The specific gravity of the solid core may be set in a range of 1.000 or more, preferably, 1.050 or more, more preferably, 1.100 or more, with the upper limit being set in a range of 1.300 or less, preferably, 1.250 or less, more preferably, 1.200 or less.

The solid core may be of one layer structure or a multilayer structure having two or more layers insofar as the deformed amount and the hardness distribution of the solid core satisfy the above-described requirements thereof.

As a base resin for forming the cover provided to cover the above-described core, there can be used any known cover material, for example, an ionomer resin, or a polyurethane, polyamide, or polyester based thermoplastic elastomer. These materials may be used singly or in combination of two or more kinds thereof. It is to be noted that as the ionomer resin, thermoplastic elastomer, or the like, there can be used a commercial product.

The cover material used in the present invention is preferably obtained by adding an inorganic filler to a base resin. The content of the inorganic filler may be set, on the basis of 100 parts of the base resin, in a range of 2 parts or more, preferably, 2 to 50 parts, more preferably, 2 to 30 parts. As the inorganic filler, there may be used titanium dioxide or barium sulfate. In particular, the performances such as durability of the cover can be improved by adding titanium dioxide or barium sulfate in an amount of 5 parts or more, preferably, 8 parts or more.

According to the present invention, the hardness (JIS-C hardness) of the cover may be set in a range of 75 or more, preferably, 78 or more, more preferably, 80 or more, with the upper limit being set in a range of 95 or less, preferably, 93 or less, more preferably, less than 91. If the cover hardness is excessively low, the resilience may be insufficient, while if the cover hardness is excessively high, the feeling of hitting and the durability may be degraded.

The JIS-C hardness (Vh) of the cover and the surface hardness (Sh) of the core are required to satisfy the following relationship:

$$0.9\times Vh-70 \leqq Vh-Sh \leqq 0.9\times Vh-50 \quad (2)$$

If the value (Vh−Sh) is out of the above range, the durability and the feeling of hitting may be degraded, thus failing to achieve the object of the present invention.

According to the present invention, the center hardness (Ch) of the core, the surface hardness (Sh) of the core, and the cover hardness (Vh) become high in this order (Ch<Sh<Vh).

The thickness of the cover may be set in a range of 1.0 mm or more, preferably, 1.1 mm or more, with the upper limit being set in a range of 2.3 mm or less, preferably, 2.2 mm or less, more preferably, 2.1 mm or less, most preferably, 2.00 mm or less.

The specific gravity of the cover material may be set in a range of 1.020 or more, preferably, 1.030 or more, more preferably, 1.040 or more, with the upper limit being set in a range 1.110 or less, preferably, 1.090 or less.

In addition, a UV absorbent, an oxidation inhibitor, a dispersant, and a coloring agent may be added to the cover material, as needed.

The cover of the golf ball of the present invention can be formed by a known process of putting the solid core in a specific mold for injection molding, and injection molding the cover material. Alternatively, the cover can be formed by preparing a pair of cup-halves made from the cover material, putting the solid core covered with the cup-halves in a specific mold, and press-molding the resultant solid core covered with the cup-halves.

Like a general golf ball, the golf ball of the present invention has in the cover surface a large number of dimples. The total number of the dimples may be set in a range of 350 or more, preferably, 370 or more, more preferably, 390 or more, with the upper limit being set in a range of 500 or less, preferably, 480 or less, more preferably, 450 or less. As the geometrical arrangement of the dimples, there can be adopted an octahedron or icosahedron arrangement. The pattern of the dimple is not limited to a circular shape but may be a square, hexagonal, pentagonal, or triangular shape.

The golf ball of the present invention can be produced with its diameter and weight specified under a golf rule for golf games. Concretely, the diameter of the golf ball can be set in a range of 42.67 mm or more, with the upper limit being in a range of 44.0 mm or less, preferably, 43.5 mm or less, more preferably, 43.0 mm or less, and the weight of the golf ball can be set in a range of 45.93 g or less, with the lower limit being in a range of 44.5 g or more, preferably, 44.8 g or more, more preferably, 45.0 or more.

As described above, the present invention can provide a golf ball having a high carrying performance, a good controllability, a desirable very soft feeling of hitting, and an excellent durability against continuous hitting.

EXAMPLE

The present invention will be more clearly understood by way of, while not limited thereto, the following examples and comparative examples. In the examples, "parts" designate parts by weight.

Examples 1 to 3 and Comparative Examples 1 to 3

A two-piece solid golf ball including a solid core and a cover was produced from each of rubber compositions shown in Table 1 by a known process.

TABLE 1

| | | Example | | | Comparative Example | | |
|---|---|---|---|---|---|---|---|
| | | 1 | 2 | 3 | 1 | 2 | 3 |
| Composition of Core (part by weight | Cis-1,4-polybutadiene | 100 | 100 | 100 | 100 | 100 | 100 |
| | Zinc acrylate | 22.5 | 19.4 | 21.6 | 31.1 | 22.5 | 27.0 |
| | Zinc oxide | 5 | 5 | 5 | 5 | 5 | 5 |
| | Barium sulfate | 20.3 | 17.0 | 22.3 | 18.2 | 20.3 | 25.7 |
| | Dicumyl peroxide | 1.4 | 1.4 | 1.4 | 1.4 | 1.4 | 1.4 |
| Data of Core | Deformed amount (mm) under load of 980 N | 5.1 | 5.8 | 5.3 | 3.2 | 5.1 | 4.1 |
| | Center hardness (Ch) of core | 52 | 49 | 51 | 61 | 52 | 65 |
| | Surface hardness (Sh) of core | 68 | 62 | 66 | 83 | 68 | 70 |
| | (1.55 × Ch-16) | 65 | 60 | 63 | 79 | 65 | 85 |
| | (1.55 × Ch-10) | 71 | 66 | 69 | 85 | 71 | 91 |
| Composition of Cover (part by weight) | Himilan 1557 | 55 | | | | | |
| | Himilan 1601 | 45 | | | | | |
| | Himilan 1605 | | 35 | 35 | | | |
| | Himilan 1706 | | 35 | 35 | | | 50 |
| | Himilan 1650 | | | | 50 | | 50 |
| | Surlyn 8320 | | | | 50 | | |
| | Himilan AM7317 | | | | | 50 | |
| | Himilan AM7318 | | | | | 50 | |
| | Dynaron EP6100P | | 30 | 30 | | | |
| | Barium sulfate | 3 | 10 | | | | |
| | Titanium dioxide | 5 | 5 | 3 | 2 | 2 | 2 |
| Physical Properties of Cover | Hardness (Vh) of cover | 90 | 87 | 85 | 77 | 98 | 94 |
| | 0.9 × Vh-70 | 11 | 8.3 | 6.5 | −0.7 | 18.2 | 14.6 |
| | Vh-Sh | 22 | 25 | 19 | −6 | 30 | 24 |
| | 0.9 × Vh-50 | 31 | 28.3 | 26.5 | 19.3 | 38.2 | 34.6 |
| | Thickness (mm) of cover | 1.9 | 1.9 | 1.9 | 1.9 | 1.9 | 3.9 |
| Ball | Outer diameter (mm) of core | 42.7 | 42.7 | 42.7 | 42.7 | 42.7 | 42.7 |
| | Weight (g) of core | 45.1 | 44.7 | 45.2 | 45.2 | 44.9 | 45.2 |
| Carry | HS45(m) | 225.2 | 224.6 | 225.1 | 223.1 | 225.0 | 224.3 |
| | HS35(m) | 163.5 | 165.2 | 163.7 | 160.1 | 163.6 | 161.0 |
| Durability against Continuous Hitting | | ⊚ | ⊚ | ⊚ | ⊚ | x | x |
| Feeling of Hitting | | ⊚ | ⊚ | ⊚ | x | ○ | x |
| Controllability | | ⊚ | ⊚ | ⊚ | x | ○ | ○ |

Each golf ball thus obtained was evaluated in terms of carrying performance, durability against continuous hitting, feeling of hitting, and controllability in accordance with the following manners. The results are shown in Table 1.

In Table 1, the hardness is expressed in JIS-C hardness, and further, "Himilan" is an ionomer resin sold by Du Pont-Mitsui Polychemicals Co., Ltd; "Surlyn" is an ionomer resin sold by Du Pont DE NEMOURS & COMPANY, USA; and "Dynaron" is a polyolefine based thermoplastic elastomer sold by JSR Co., Ltd.

Measurement of Carry:

The ball was hit with a hitting machine (sold by Miyamae Co., Ltd.), to which a driver with a loft angle of 100 (sold by Bridgestone Sports Co., Ltd.) was mounted, and the carry of the ball was measured.

Durability against Continuous Hitting:

The durability against continuous hitting, which was performed by a rotary drum type continuous hitting machine, was evaluated.

◎: very good

○: good

X: undesirable

Feeling of Hitting:

The feeling of hitting of the golf ball was evaluated by a function test performed by 10 of professional players and 10 of amateur players.

◎: very soft

○: soft

X: hard

Controllability:

The controllability of the golf ball was evaluated by a function test actually performed on a putting green of a golf course. The controllability was evaluated by the total of spin, soft feeling of hitting, easy contact of ball with a club face, and the like.

◎: very good

○: good

X: undesirable

As is apparent from Table 1, the golf ball in Examples 1 to 3 is superior to the golf ball in Comparative Example 1 to 3 in terms of carrying performance, durability against continuous hitting, feeling of hitting, and controllability.

While the present invention has been described using specific terms, such description is for illustrative purposes only, and it is understood that changes and variations may be made without departing from the spirit of scope of the following claims.

What is claimed is:

1. A golf ball comprising a solid core and a cover, wherein a deformed amount of said solid core, measured by applying a load of 980 N thereto, is in a range of 4.0 to 6.0 mm;

a JIS-C hardness of said cover is in a range of 75 to 95;

a JIS-C hardness (Sh) of a surface of said core and a JIS-hardness (Ch) of a center portion of said core satisfy a relationship of $$1.55\times Ch-16\leqq Sh\leqq 1.55\times Ch-10;$$

a JIS-C hardness (Vh) of said cover and a JIS-C hardness (Sh) of the surface of said core satisfy a relationship of $$0.9\times Vh-70\leqq Vh-Sh\leqq 0.9\times Vh-50;\text{ and}$$

the hardnesses of the center portion of said core, the surface of said core, and said cover become higher in this order.

2. A golf ball according to claim 1, wherein the JIS-C hardness of the center portion of said core is in a range or 40 to 65.

3. A golf ball according to claim 1, wherein the JIS-C hardness of the surface of said core is in a range of 55 to 80.

4. A golf ball according to claim 1, wherein said cover is formed from a base resin containing an inorganic filler in an amount of 2 parts by weight on the basis of 100 parts by weight of said base resin.

5. A golf ball according to claim 1, wherein a thickness of said cover is in a range of 1.0 to 2.3 mm.

6. A golf ball according to claim 1, wherein the lower limit of the deformed amount of said solid core, measured by applying a load of 980 N thereto, is 4.2 mm.

7. A golf ball according to claim 1, wherein the lower limit of the deformed amount of said solid core, measured by applying a load of 980 N thereto, is 4.3 mm.

* * * * *